US008651929B2

(12) United States Patent
Moody

(10) Patent No.: US 8,651,929 B2
(45) Date of Patent: Feb. 18, 2014

(54) VIDEO POKER WITH AN OPPONENT HAND

(75) Inventor: Ernest W. Moody, Las Vegas, NV (US)

(73) Assignee: Ernest Moody Revocable Trust, Las Vegas, NV (US)

( * ) Notice: Subject to any disclaimer, the term of this patent is extended or adjusted under 35 U.S.C. 154(b) by 1747 days.

(21) Appl. No.: 11/513,998

(22) Filed: Aug. 31, 2006

(65) Prior Publication Data

US 2007/0060242 A1 Mar. 15, 2007

Related U.S. Application Data

(60) Provisional application No. 60/717,467, filed on Sep. 14, 2005.

(51) Int. Cl.
*A63F 9/24* (2006.01)

(52) U.S. Cl.
USPC ..... 463/13; 273/236; 273/274

(58) Field of Classification Search
USPC ..... 463/13; 273/236, 274
See application file for complete search history.

(56) References Cited

U.S. PATENT DOCUMENTS 5,879,233 A * 3/1999 Stupero ..... 463/11
7,207,563 B2 * 4/2007 Samberg ..... 273/292

* cited by examiner

*Primary Examiner* — Corbett B Coburn
(74) *Attorney, Agent, or Firm* — John Edward Roethel

(57) ABSTRACT

The game involves playing video poker in a contest between a player and an opponent. The player makes a wager to be eligible to play the game and the player plays an initial hand of video poker against an opponent who plays the same initial hand of video poker. If the player beats the opponent, the player wins an award. If the opponent beats the player, the player loses. If the player and the opponent tie, then any amount in the pot carries over to the next round, a new wager is made by the player to play the next round and the player and the opponent play another hand of video poker. This continues until either the player or the opponent win a round outright. Each of the player and the opponent start with the same initial cards on each hand that is played in any particular round.

20 Claims, 6 Drawing Sheets

VIDEO POKER WITH AN OPPONENT HAND

CROSS-REFERENCE TO RELATED APPLICATION

This application is based on and claims the benefit of U.S. Provisional Application Ser. No. 60/717,467, filed Sep. 14, 2005.

This invention relates primarily to video poker games, and more particularly to video poker games that include a wagering game in which the player plays against at least one opponent. The wagering game includes a skins feature in which tying hands carry over to the next deal.

BACKGROUND OF THE INVENTION

Video poker that is played on an electronic video poker gaming machine is designed to replicate the play of a hand of poker. Typically, the player is not playing against any other player's hands or against a dealer's hand; the player is simply attempting to achieve the highest ranking poker hand possible from the cards displayed to the player. The higher the ranking of the poker hand achieved by the player, the greater the player's winnings based on the number of coins, tokens or credits wagered by the player. Typically, a payout schedule is posted on the gaming machine to advise the player of the payoffs available for certain winning card combinations.

The forerunner of all electronic video poker gaming machines is the video Draw Poker machine that deals cards from a fifty-two card poker deck and displays a single five card hand to the player. The player then selects which of the five cards he wishes to hold (or discard depending on the format of the gaming machine). The draw poker machine then displays replacement cards for the cards the player has discarded. The player wins or loses based on conventional poker hand rankings for the resulting five card hand. In video Draw Poker, the conventional poker hand rankings that are winning combinations are a Royal Flush, a Straight Flush, a Four of a Kind, a Full House, a Flush, a Straight, a Three of a Kind, a Two Pair and a Pair of Jacks or Better. A payout table is established based on the number of coins wagered by the player and the type of poker hand achieved.

The classic draw poker machine has been modified to use Jokers as wild cards or to use Deuces (or even other cards) as wild cards. "Jokers Wild" and "Deuces Wild" draw poker still display to the player a single five card hand and allow the player to discard unwanted cards and receive replacement cards. The payout table is modified to recognize the differing odds for achieving various poker hands when wild cards are involved. Furthermore, different poker hand rankings are used in the pay table to recognize different winning combinations that can be achieved using wild cards.

There are many poker formats used in video draw poker. These poker game formats include Jacks (or even Tens) or Better Draw Poker, Bonus Poker, Double Bonus Poker, Double Double Bonus Poker, Super Double Bonus Poker, Triple Bonus Poker, Deuces Wild Poker, Jokers Wild Poker, Deuces and Jokers Wild Poker, etc. Many electronic video poker gaming machines are provided with a menu so that the player can indicate his choice of the poker game format that the player wishes to play and the player then makes his wager based on upon that choice of poker game format. Each poker format has its own pay table associated therewith.

There is a need in the gaming industry for new and exciting games to keep the player's interest. The present invention uses an opponent's hand which the player must beat in order to win an award. Both the player and the opponent start with the same initial hand. Should the player and the opponent tie on a hand, any pot that exists carries over to the next round and continues to carry over until either the player or the opponent win a round outright.

SUMMARY OF THE INVENTION

The game of the present invention involves playing video poker in a contest between a player and an opponent. The player makes a wager to be eligible to play the game and the player plays an initial hand of video poker against an opponent who plays the same initial hand of video poker. If the player beats the opponent, the player wins an award. If the opponent beats the player, the player loses. If the player and the opponent tie, then any amount in the pot carries over to the next round, a new wager is made by the player to play the next round and the player and the opponent play another hand of video poker. This continues until either the player or the opponent win a round outright. Each of the player and the opponent start with the same initial cards on each hand that is played in any particular round.

DETAILED DESCRIPTION OF THE PREFERRED EMBODIMENTS

The method of the present invention can be applied to any poker game format used for video poker. These poker game formats include Jacks (or even Tens) or Better Draw Poker, Bonus Poker, Double Bonus Poker, Double Double Bonus Poker, Super Double Bonus Poker, Triple Bonus Poker, Deuces Wild Poker, Jokers Wild Poker, Deuces and Jokers Wild Poker, and many others. Even Lo-ball poker game formats may be adapted to the method of play of the present invention.

If a Joker poker game format is used, one or more Jokers are added to the deck of cards. Many electronic video poker gaming machines are provided with a menu so that the player can indicate his choice of the poker game format that the player wishes to play. Each poker format has its own pay table associated therewith. The pay table shows payout amounts based on the amount wagered and the winning card combination.

Figure 1:
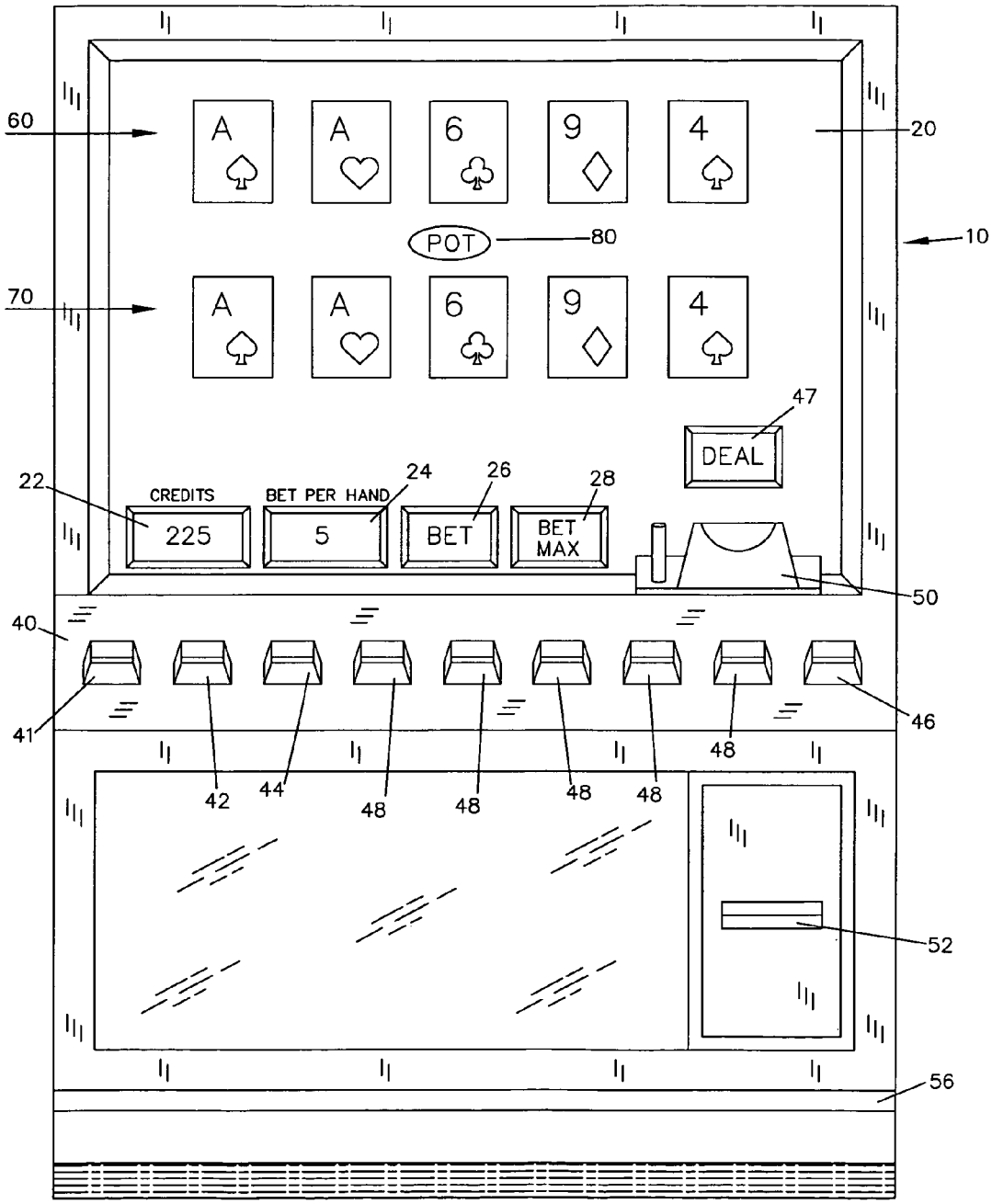
FIG. 1 shows a representative electronic video gaming machine of the present invention including a typical screen display used in the method of play of version #1 of the present invention after the initial deal of the cards.

FIG. 1 shows generally at 10 a typical electronic video gaming machine that is configured to provide to the player the method of the present invention. The electronic video gaming machine 10 includes a conventional coin head 50 into which the player can insert coins or gaming tokens and a slot 52 which leads to a conventional bill acceptor mounted on the interior of the gaming machine and into which the player can insert paper currency. The use of coins, tokens or paper currency is the mechanism by which the player wagers on the poker hands the player wishes to play. As is also conventional in electronic video gaming machines, a credit meter display 22 is provided to show the amount of credits that the player has accrued on the gaming machine 10—either by inserting coins, tokens or paper currency or from winning plays achieved by the player. Whenever the player makes a wager, the amount of the wager is decremented from the credit meter display 22. Whenever the player achieves a winning play during the play of the game, the amount of the winning play is incremented on the credit meter display 22.

A conventional payout hopper is also located on the interior of the gaming machine and is used to dispense coins or tokens to the player into a payout tray 56 when the player wishes to collect any winning amounts the player has accrued. Other suitable and conventional payout mechanisms can be used, such as a ticket printer or other cashless payout devices.

The gaming machine 10 also includes a video screen display 20 of any suitable type upon which representations of playing cards are displayed. In a preferred embodiment of the present invention, one or more hands can be displayed on the video screen display 20 at the same time. The video screen display 20 also contains a location at which the amount wagered on each hand is shown, for example, "Bet Per Hand" 24.

A button panel 40 is also provided on the gaming machine 10 and the buttons mounted on the button panel 40 are used by the player to control the operation of the gaming machine 10. Any suitable configuration of the buttons on the button panel can be used and, alternatively, conventional touch screen technology can be used for any or all of the buttons mounted on the button panel.

A typical button arrangement is shown on the button panel 30 in FIG. 1. A "BET ONE" button 42 is provided to allow the player to wager one credit at a time. A "BET MAX" button 44 is provided to allow the player to wager the maximum amount of credits permitted by the configuration of the gaming machine 10. Any number of credits can be set as the maximum amount that it is possible to wager on each hand and, typically, five credits will be the maximum number of credits for any particular hand. Alternatively, a BET ONE location 26 and a BET MAX location 28 can be provided on the video screen 20 to allow the player to wager by using conventional touch screen technology.

A conventional "DEAL" button 46 is also provided on the button panel 40 which is used by the player to activate the initial deal of the cards at the deal stage of the method of play or the dealing of replacement cards at the draw stage of the method of play as is appropriate. Similarly, a DEAL location 47 can be provided on the video screen 20 to allow the player to effect either the deal step or the draw step by using conventional touch screen technology.

The method of play of the various versions of the present invention will now be described. After the player has inserted an appropriate amount of coins, tokens or paper currency to add a sufficient amount of credits on the credit display meter 22, the player makes his wager. The player may press the BET ONE button 42 one or more times to bet in single increments or the player may merely press the "BET MAX" button 44 and the maximum number of credits are applied, for example, five credits would be wagered. The player can also use the touch screen locations to make his wager as described above. The wager made by the player is required for the player to be eligible to win monetary payouts during the play of the game.

Alternatively, the method of play may be effected without a wager so that the game can be played as merely an amusement game without receiving monetary payouts.

Version #1

This version of the present invention is played using a deck of cards. The deck of cards could be the conventional fifty-two card deck having four suits and thirteen ranks. Alternatively, if the poker game format being used is a Joker poker game format, then one or more Jokers would be added to the fifty-two cards to create a deck of cards suitable for Joker poker game formats.

The player makes a wager to participate in the method of play and to be eligible for monetary payouts. During the course of play, various monetary amounts are accumulated into a pot 80. The player is playing against the opponent to try to win the amount in the pot 80.

After the wager is made, a five card hand, the initial PLAYER HAND 60 shown in FIG. 1, is dealt to the player. The same five card hand by suit and rank is dealt to the opponent, the initial OPPONENT HAND 70. A replacement deck of cards is created consisting of the deck of cards less the cards in the initial player hand. The replacement cards for each of the PLAYER HAND 62 and the OPPONENT HAND 72 are dealt from the replacement deck which is a depleted deck of forty-seven cards which represent the remaining forty-seven cards after the initial five cards of the initial hand have been removed. These forty-seven cards are virtually shuffled so that the PLAYER HAND 62 and the OPPONENT HAND 72 would most likely not receive the same replacement cards.

Figure 2:
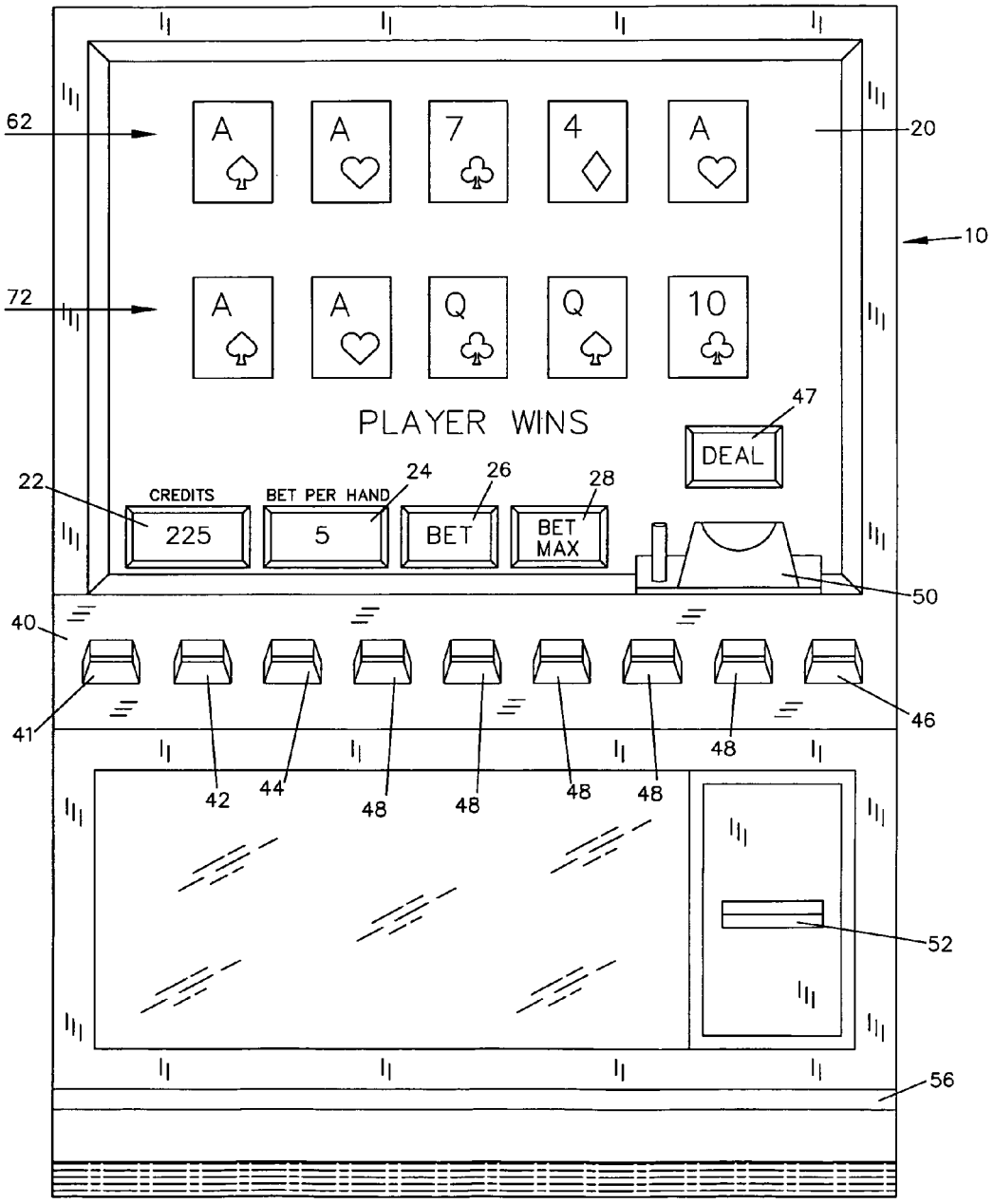
FIG. 2 shows a representative electronic video gaming machine of the present invention including a typical screen display used in the method of play of version #1 of the present invention after the draw step and the dealing of replacement cards.

The player selects which cards to hold and the unheld cards are discarded and replacement cards are dealt therefore from the replacement deck. The player now has a final PLAYER HAND 62 as shown in FIG. 2. The opponent selects which cards to hold and the unheld cards are discarded and replacement cards are dealt therefore from the same replacement deck. The opponent now has a final OPPONENT HAND 72 as shown in FIG. 2.

In the preferred embodiment of the present invention, the protocol for selecting which cards the opponent will hold and discard is determined by having the opponent play the hand according to the best mathematical expectation based on the starting cards in the opponent hand. A suitable way of doing this is disclosed in U.S. Pat. No. 6,343,989 (Wood et al.) (the disclosure of which is incorporated herein), which shows how expected value is used to determine the best manner of playing any particular starting hand.

The player, of course, is not bound to any particular strategy for this hold and discard selection so the player could hold and discard different cards than those that are held and discarded by the opponent.

Between the final PLAYER HAND 62 and the final OPPONENT HAND 72, the hand with the highest poker hand ranking BY CATEGORY is the winning hand.

Poker hand categories are displayed in the pay table, Table 1, with the categories based on the poker format being used.

Any suitable pay table may be used and would be associated with the poker format being used by the player. For example, a classic poker hand format is Jacks or Better Draw Poker. A suitable pay table for Jacks or Better Draw Poker is shown in Table 1:

TABLE 1

| JACKS OR BETTER DRAW POKER | NUMBER OF COINS WAGERED | | | | |
|---|---|---|---|---|---|
| POKER HAND RANKING | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| PAIR JACKS OR BETTER | 1 | 2 | 3 | 4 | 5 |

For example, if Jacks or Better Draw Poker is the poker format being used, the poker categories shown highest to lowest are:

Royal Flush
Straight Flush
Four-of-a-Kind
Full House
Flush
Straight
Three-of-a-Kind
Two Pair
Pair Jacks or Better
All other card combinations The payout amounts shown in Table 1 are accumulated in the pot 80 based on the poker hand ranking of both the final PLAYER HAND 62 and the final OPPONENT HAND 72. The amount wagered by the player determines which column of the pay table is used for the payout amount based on the poker hand ranking of the final PLAYER HAND 62. For the final OPPONENT HAND 72, the opponent is considered to have wagered the same amount as the player wagered.

When the payout amount, if any, for the final PLAYER HAND 62 and the payout amount for the final OPPONENT HAND 72 is determined, these amounts are accumulated into the pot 80. Whether the player has won the amount in the pot 80 is then determined.

If the final PLAYER HAND 62 has the highest poker hand ranking by category, then the player wins the amount in the pot 80. If the final OPPONENT HAND 72 has the highest poker hand ranking by category, then the player loses that round of play and the pot 80 reverts to a zero amount.

Any time that the player and opponent tie with the same final poker hand by category, the amount in the pot 80 carries over to the next round of play. Thus, unlike conventional multi-player poker games in which the highest ranking poker hand wins the pot, in the present invention, a winning hand must be the highest poker hand BY CATEGORY. In conventional multi-player poker games, a Nine-high Straight beats a Seven-high Straight. In the present invention, these hand would tie. In conventional multi-player poker games, three Jacks beat three Eights. In the present invention, these hand would tie.

As an alternative method of play, if the final player hand and the final opponent hand ties with the highest poker hand BY PAYOUT AMOUNT, the amount in the pot carries over and the player and the opponent go on to the next round. For example, in some poker formats, the payout for Jacks or Better and the payout for Two Pair is the same payout. If such a format were being used and the final player hand were a Pair of Queens and the final opponent hand were a Pair of Queens and Pair of Sixes, then each of the player and the opponent would have the same payout amount and the hand would be considered a tie. The amount in the pot would then carry over to the next round of play.

FIG. 1 and FIG. 2 show an example of the method of play. The player wagers five credits to be eligible to win an award. The PLAYER HAND 60 and the OPPONENT HAND 70 each start with Ace of Spades, Ace of Hearts, Seven of Clubs, Four of Diamonds and Ace of Hearts. The player decides to hold the Ace of Spades and the Ace of Hearts. Using a suitable expected value analysis, the computer controls determine that the opponent should also hold the Ace of Spades and the Ace of Hearts.

Replacement cards are randomly dealt from the replacement deck and displayed for the unheld cards into the PLAYER HAND 62 and replacement cards are randomly dealt from the replacement deck and displayed for the unheld cards into the OPPONENT HAND 72.

After the hold and discard step, the final PLAYER HAND 62 has Ace of Spades, Ace of Hearts, Seven of Clubs, Four of Diamonds and Ace of Hearts for a final PLAYER HAND 62 of Three-of-a-Kind. The final OPPONENT HAND 72 has Ace of Spades, Ace of Hearts, Queen of Clubs, Queen of Spades and Ten of Clubs for a final OPPONENT HAND of Two Pair. The player wins since a Three-of-a-Kind is a higher category than a Two Pair. The payout amount as shown in Table 1 for the final PLAYER HAND 62 of Three-of-a-Kind would be fifteen credits and the payout amount as shown in Table 1 for the final OPPONENT HAND 72 of Two Pair would be ten credits and each of these amounts are accumulated into the pot 80.

Since the player had the winning hand, the player wins the entire pot 80 of twenty-five credits.

Figure 3:
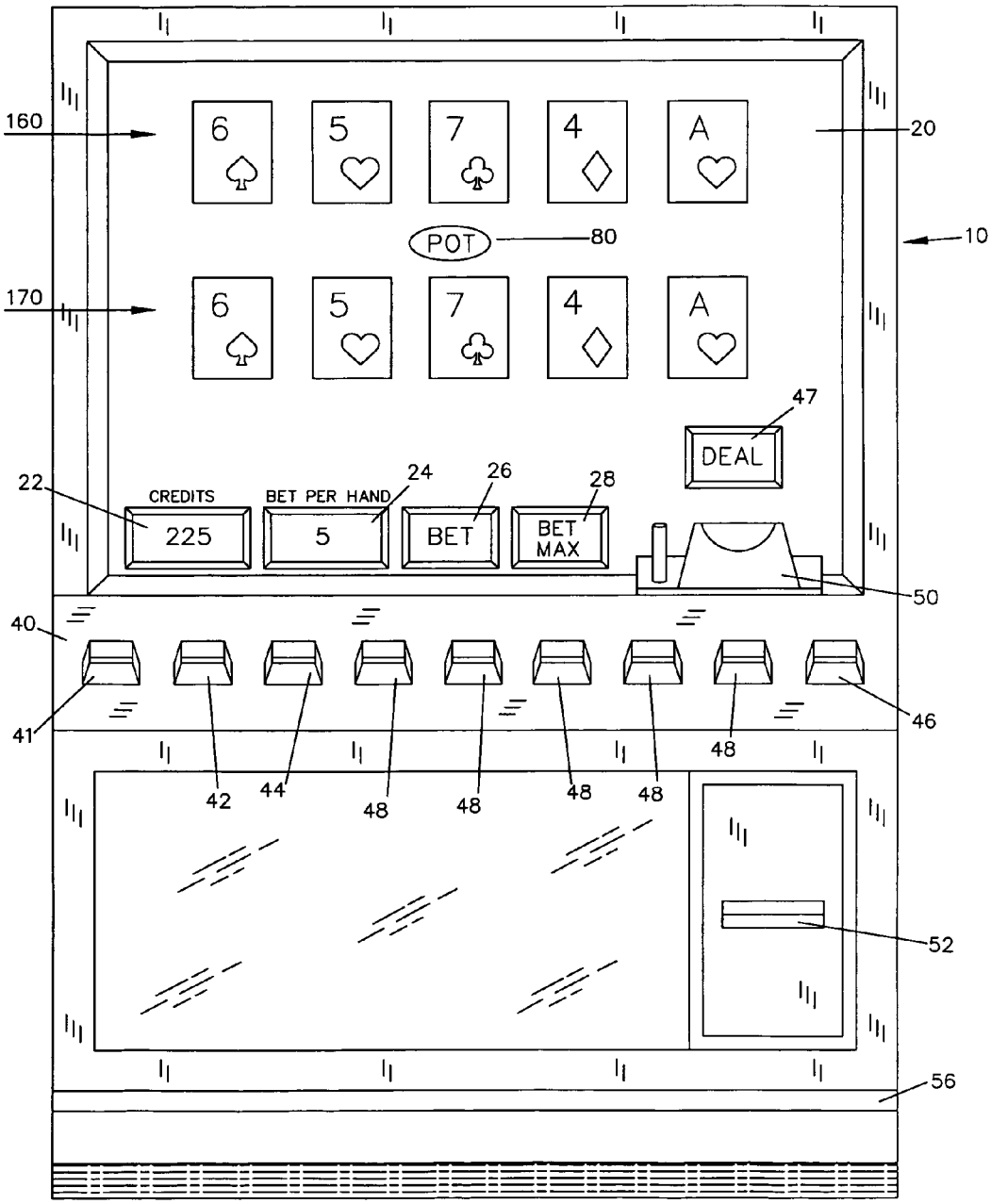
FIG. 3 shows a representative electronic video gaming machine of the present invention including a typical screen display used in the method of play of version #1 of the present invention after the initial deal of the cards.
Figure 4:
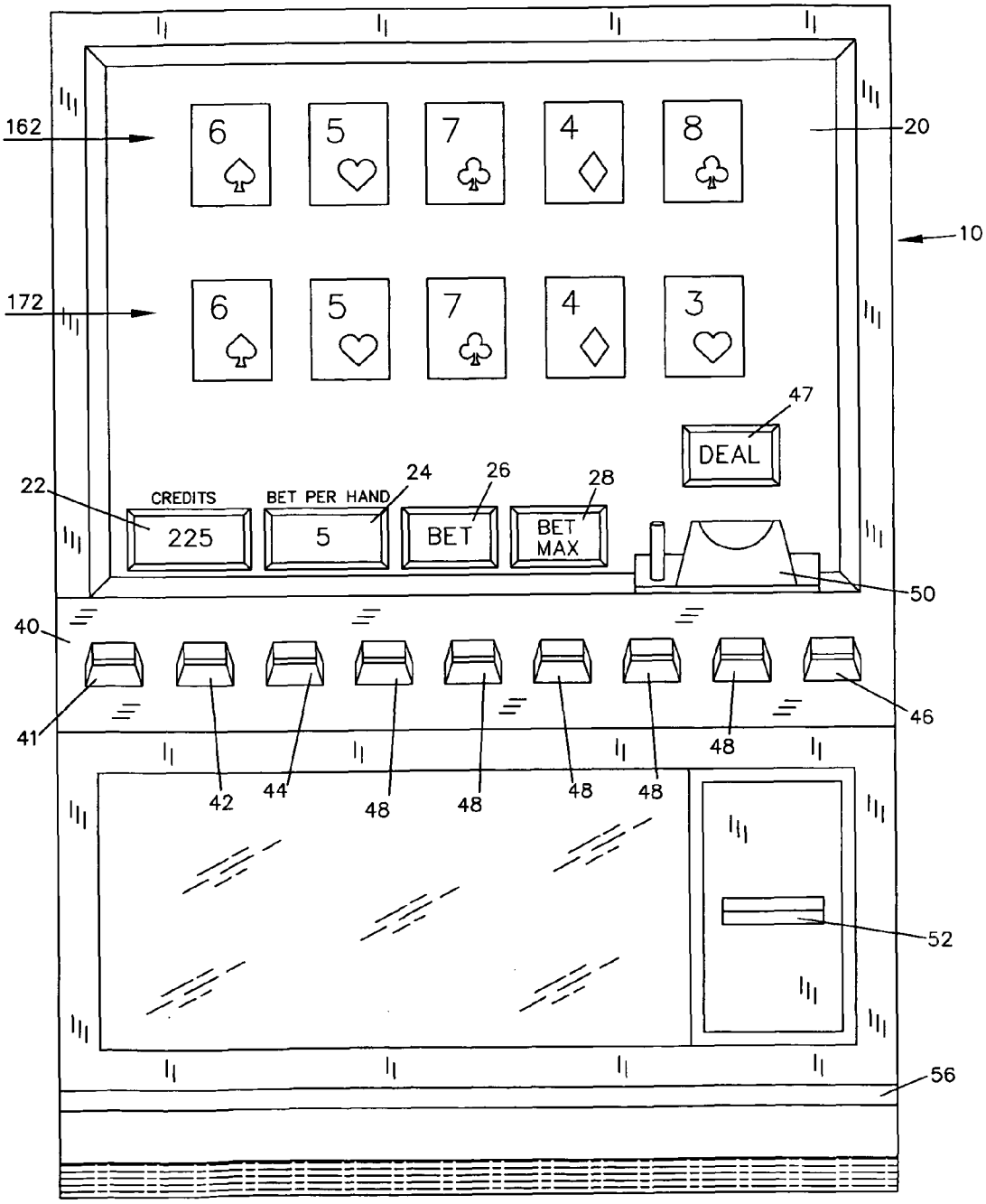
FIG. 4 shows a representative electronic video gaming machine of the present invention including a typical screen display used in the method of play of version #1 of the present invention after the draw step and the dealing of replacement cards when a carryover hand occurs.
Figure 5:
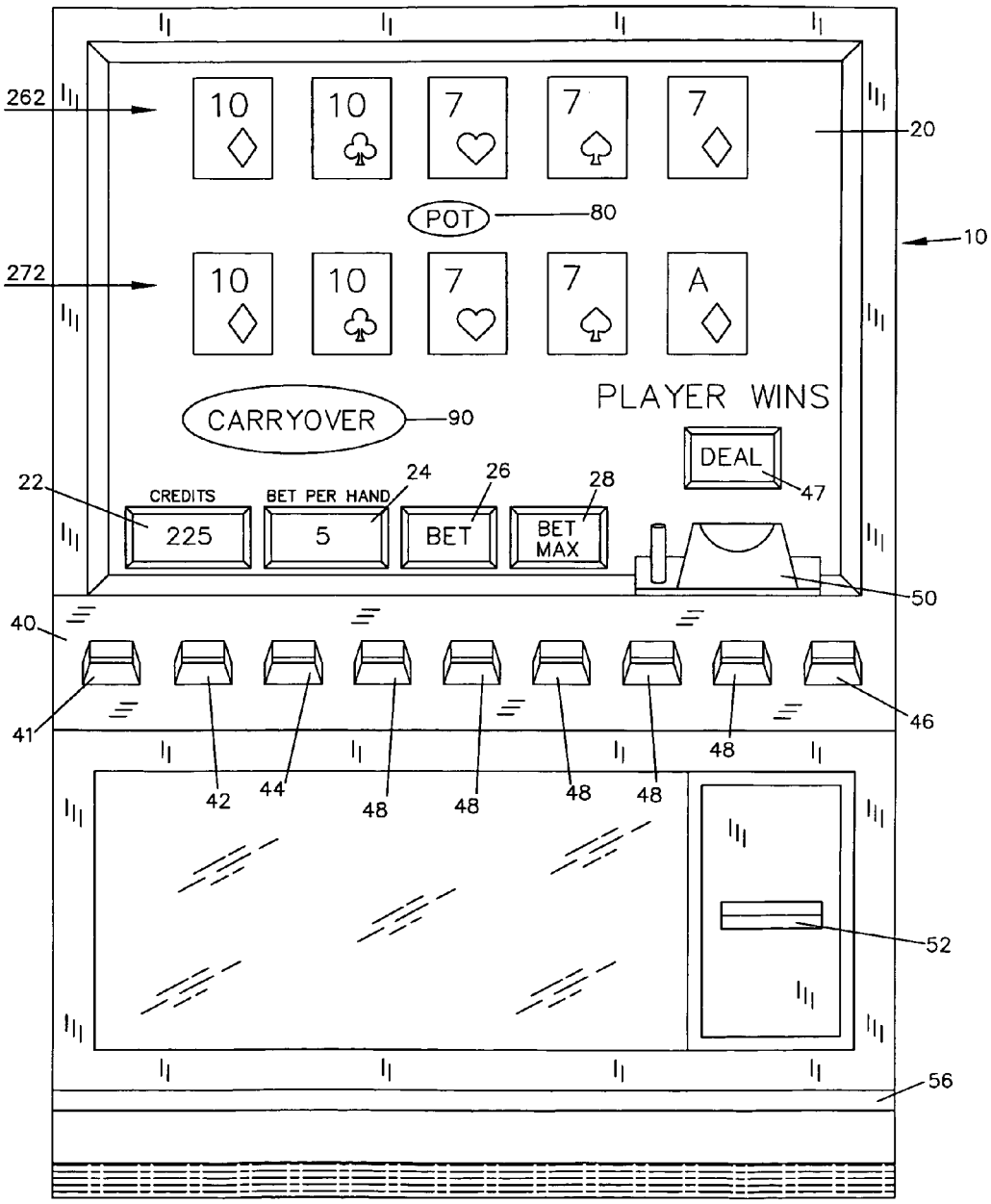
FIG. 5 shows a representative electronic video gaming machine of the present invention including a typical screen display used in the method of play of version #1 of the present invention after the draw step and the dealing of replacement cards showing the resolution of the game following a carryover round.

FIG. 3, FIG. 4 and FIG. 5 show an example of a method of play in which a carryover occurs.

The player wagers five credits to be eligible to win an award. The PLAYER HAND 160 and the OPPONENT HAND 170 each start with Six of Spades, Five of Hearts, Seven of Clubs, Four of Diamonds and Ace of Hearts.

The player decides to hold the Six of Spades, the Five of Hearts, the Seven of Clubs and the Four of Diamonds. Using a suitable expected value analysis, the computer controls determine that the opponent should also hold the Six of Spades, the Five of Hearts, the Seven of Clubs and the Four of Diamonds. Replacement cards are dealt and displayed for the unheld cards into both the PLAYER HAND 162 and the OPPONENT HAND 172.

After the hold and discard step, the final PLAYER HAND 162 has the Six of Spades, the Five of Hearts, the Seven of Clubs and the Four of Diamonds and the Eight of Clubs for a final PLAYER HAND 162 of a Straight. The final OPPONENT HAND 172 has the Six of Spades, the Five of Hearts, the Seven of Clubs and the Four of Diamonds and the Three of Hearts for a final OPPONENT HAND 172 of a Straight. Because both the player and the opponent have both achieved the same category of poker hand, this round of play is a tie. It does not matter that in a conventional multi-player poker game, the player would win because his Eight high Straight would beat a Seven high Straight.

The payout amount as shown in Table 1 for the final PLAYER HAND 162 of a Straight would be twenty credits and the payout amount as shown in Table 1 for the final OPPONENT HAND 172 of a Straight would be twenty credits and each of these amounts are accumulated into the pot 80.

This tie outcome results in the pot of forty credits being carried over to the next round of play. The carryover pot 90 now has forty credits. In the next round of play, the player makes another wager of five credits to be eligible to win the carryover pot 90 plus any other amounts accumulated in the pot 80 during the next round of play.

FIG. 5 shows the outcome of the second round of play. Both the player and the opponent have held the same four cards from an initial deal: the Ten of Diamonds, the Ten of Clubs, the Seven of Hearts and the Seven of Spades. The final PLAYER HAND 262 shows the player received the Seven of Diamonds as the replacement card resulting in the player achieving a Full House. The final OPPONENT HAND 272 shows the opponent received the Ace of Diamonds as the replacement card resulting in the opponent achieving a Two Pair. The player wins since a Full House is a higher category than a Two Pair.

The payout amount as shown in Table 1 for the final PLAYER HAND 262 of a Full House would be forty credits and the payout amount as shown in Table 1 for the final OPPONENT HAND 272 of Two Pair would be ten credits and each of these amounts are accumulated into the pot 80.

Since the player has the higher winning final hand of a Full House, the player wins a total of one hundred forty credits from the combined pot 80 and carryover pot 90.

It is also possible to add additional wagers to the basic opponent game described above. The player may make side wagers on both the final player hand and the final opponent hand. These wager are determined based solely on the poker hand ranking of the final player hand and the final opponent hand.

The poker hand ranking of the final player hand determines if the player wins his side bet on the player hand. The poker hand ranking of the final opponent hand determines if the player wins his side bet on the opponent hand. The payouts for the winning poker hand rankings for these side bets are determined by using a pay table, such as the pay table shown in Table 1.

Version #2

This Version #2 is played similarly to Version #1 except that there are two or more opponent hands. Again each of the player hand and the multiple opponents hands start with the same initial five card hands.

Figure 6:
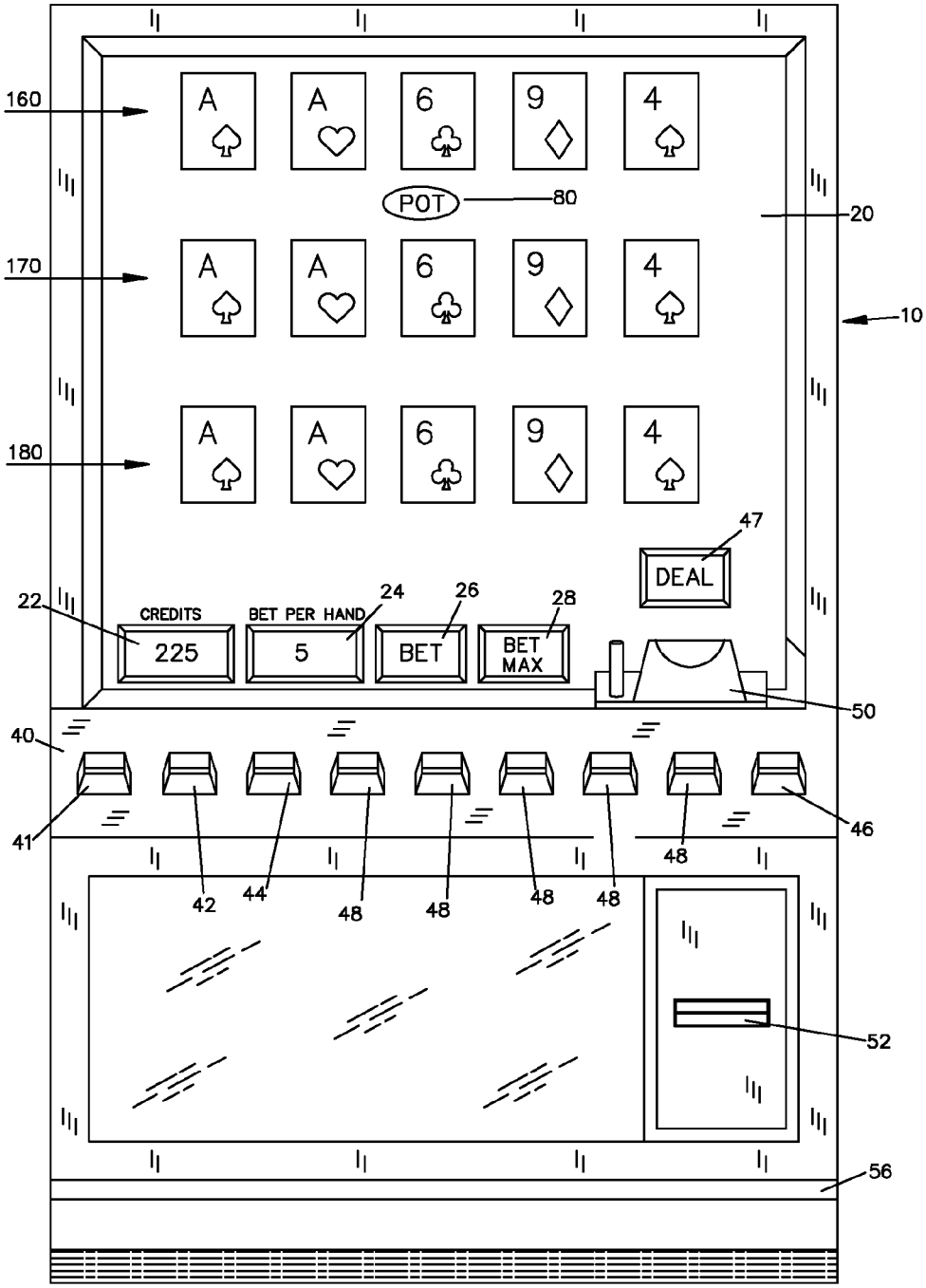
FIG. 6 shows a representative electronic video gaming machine of the present invention including a typical screen display used in the method of play of version #2 of the present invention after the initial deal of the cards.

As shown in FIG. 6, each of a player's initial hand 160, an initial first opponent hand 170 and an initial second opponent hand 180 are displayed with the same starting cards. The method of play of this Version #2 proceeds in a manner similar to that of Version #1, above.

In this version, if any two or more of the player or opponents tie with the highest poker hand BY CATEGORY, the pot carries over and all of the player and the opponents go on to the next round. In other words, no one is eliminated from continuing to play as long as there is a tie in a round of play.

Again as an alternative method of play, if two or more of the player or opponents tie with the highest poker hand BY PAYOUT AMOUNT, the pot carries over and all of the player and the opponents go on to the next round.

The method of the present invention has been described in connection with an electronic video poker gaming machine in which the player is playing against one or more virtual opponents represented in the computer software of the gaming machine.

As an alternative embodiment of the present invention, the method of play may be played as a live casino game at a gaming table in which a live dealer acts as the opponent.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a video poker card game in which a single player plays against at least one opponent comprising:

providing an electronic video poker gaming machine having a video screen display which displays the play of the game, the electronic video poker gaming machine also having an input device by which the player can control the play of the game, and the electronic video poker gaming machine also including computer software to effect a computerized implementation of the game by the steps of:

a) providing a deck of cards;

b) displaying cards of an initial player hand and displaying cards of an initial opponent hand, the initial player hand and the initial opponent hand having the same cards by suit and rank;

c) a remaining deck being created consisting of the deck of cards less the cards of the initial player hand;

d) allowing a player to discard none, one or more of the cards of the initial player hand and displaying replacement cards for any cards discarded from the initial player hand to create a final player hand, the replacement cards being randomly selected from the remaining deck;

e) allowing an opponent to discard none, one or more of the cards of the initial opponent hand and displaying replacement cards for any cards discarded from the initial opponent hand to create a final opponent hand, the replacement cards being randomly selected from the remaining deck; and f) determining whether the final player hand or the final opponent hand is a winning hand.

2. The method of claim 1 in which the deck of cards is a conventional fifty-two card deck having four suits and thirteen ranks.

3. The method of claim 1 in which the deck of cards is a conventional fifty-two card deck having four suits and thirteen ranks plus at least one Joker.

4. The method of claim 1 in which the player makes a wager to be eligible to win an award.

5. The method of claim 4 in which a) an amount associated with the final player hand and an amount associated with the final opponent hand are each accumulated into a pot; and b) the pot is awarded to the player if the final player hand is the winning hand.

6. The method of claim 5 in which the pot carries over to another round of the game if the final player hand and the final opponent hand tie.

7. The method of claim 6 in which the final player hand and final opponent hand tie if they each have the same poker hand by category.

8. The method of claim 6 in which the final player hand and final opponent hand tie if they each have the same poker hand by pay out amount.

9. The method of claim 4 in which the amount associated with the final player hand is determined with reference to a pay table and the amount associated with the final opponent hand is determined by reference to a pay table.

10. The method of claim 9 in which the amount associated with the final player hand is determined with reference to the amount wagered by the player and the amount associated with the final opponent hand are determined by reference to the amount wagered by the player.

11. A method of playing a video poker card game in which a single player plays against at least two opponents comprising:

providing an electronic video poker gaming machine having a video screen display which displays the play of the game, the electronic video poker gaming machine also having an input device by which the player can control the play of the game, and the electronic video poker gaming machine also including computer software to effect a computerized implementation of the game by the steps of:

a) providing a deck of cards;

b) displaying cards of an initial player hand and displaying cards of an initial first opponent hand and initial second opponent hand, the initial player hand and the initial first opponent hand and the initial second opponent hand having the same cards by suit and rank;

c) a remaining deck being created consisting of the deck of cards less the cards of the initial player hand;

d) allowing a player to discard none, one or more of the cards of the initial player hand and displaying replacement cards for any cards discarded from the initial player hand to create a final player hand, the replacement cards being randomly selected from the remaining deck;

e) allowing a first opponent to discard none, one or more of the cards of the initial first opponent hand and displaying replacement cards for any cards discarded from the initial first opponent hand to create a final first opponent hand, the replacement cards being randomly selected from the remaining deck;

f) allowing a second opponent to discard none, one or more of the cards of the initial second opponent hand and displaying replacement cards for any cards discarded from the initial second opponent hand to create a final second opponent hand, the replacement cards being randomly selected from the remaining deck; and g) determining whether the final player hand or the final first opponent hand or the final second opponent hand is a winning hand.

12. The method of claim 11 in which the deck of cards is a conventional fifty-two card deck having four suits and thirteen ranks.

13. The method of claim 11 in which the deck of cards is a conventional fifty-two card deck having four suits and thirteen ranks plus at least one Joker.

14. The method of claim 11 in which the player makes a wager to be eligible to win an award.

15. The method of claim 14 in which a) an amount associated with the final player hand and an amount associated with the final first opponent hand and an amount associated with the final second opponent hand are each accumulated into a pot; and b) the pot is awarded to the player if the final player hand is the winning hand.

16. The method of claim 15 in which the pot carries over to another round of the game if at least two of the final player hand and the final first opponent hand and the final second opponent hand tie with the highest poker hand.

17. The method of claim 16 in which at least two of the final player hand and final first opponent hand and the final second opponent hand tie if they each have the same highest poker hand by category.

18. The method of claim 16 in which at least two of the final player hand and final first opponent hand and the final second opponent final hand tie if they each have the same highest poker hand by pay out amount.

19. The method of claim 14 in which the amount associated with the final player hand is determined with reference to a pay table and the amount associated with the final first opponent hand and the final second opponent hand are determined by reference to a pay table.

20. The method of claim 19 in which the amount associated with the final player hand is determined with reference to the amount wagered by the player and the amount associated with the final first opponent hand and the final second opponent hand are determined by reference to the amount wagered by the player.

* * * * *